US010454221B2

(12) United States Patent
Naito et al.

(10) Patent No.: US 10,454,221 B2
(45) Date of Patent: Oct. 22, 2019

(54) CONNECTOR MOUNTABLE ON AN UPPER SURFACE OF A CIRCUIT BOARD

(71) Applicant: JAPAN AVIATION ELECTRONICS INDUSTRY, LIMITED, Shibuya-ku, Tokyo (JP)

(72) Inventors: Takeharu Naito, Tokyo (JP); Kimiaki Saitou, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/139,846

(22) Filed: Sep. 24, 2018

(65) Prior Publication Data

US 2019/0109415 A1 Apr. 11, 2019

(30) Foreign Application Priority Data

Oct. 5, 2017 (JP) ..... 2017-195039

(51) Int. Cl.
*H01R 13/6581* (2011.01)
*H01R 13/6582* (2011.01)
(Continued)

(52) U.S. Cl.
CPC ..... *H01R 13/6582* (2013.01); *H01R 12/7005* (2013.01); *H01R 12/724* (2013.01);
(Continued)

(58) Field of Classification Search
CPC ..... H01R 13/6581; H01R 13/6582; H01R 13/6594; H01R 13/506; H01R 12/724;
(Continued)

(56) References Cited

U.S. PATENT DOCUMENTS 7,556,531 B2 7/2009 Takeuuchi et al.
8,690,608 B2 4/2014 Naito et al.
(Continued)

FOREIGN PATENT DOCUMENTS

CN 105449433 A 3/2016
JP 4368897 B2 11/2009
(Continued)

OTHER PUBLICATIONS

Extended European Search Report (EESR) dated Feb. 13, 2019 issued in counterpart European Application No. 18194159.2.
(Continued)

*Primary Examiner* — Harshad C Patel
(74) *Attorney, Agent, or Firm* — Holtz, Holtz & Volek PC

(57) ABSTRACT

A connector is provided with a plurality of contacts, a holding member and a shell. Each of the contacts has a held portion and a fixed portion. The holding member has a holding portion holding the held portion, a front regulated portion and a rear regulated portion. The shell is formed with front regulating portions, opening portions and rear regulating portions extending in the opening portions. The front regulating portions 330 are located forward of the front regulated portion 586 and regulate forward movement of the front regulated portions 586. The rear regulating portions 334 are located rearward of the rear regulated portions 588 and regulate rearward movement of the rear regulated portions 588. At least a part of the fixed portions 404 of the contacts 42 is visible through any one of the opening portions.

10 Claims, 13 Drawing Sheets

(51) Int. Cl.

| | |
|---|---|
| ***H01R 12/72*** | (2011.01) |
| ***H01R 13/405*** | (2006.01) |
| ***H01R 13/6594*** | (2011.01) |
| ***H01R 12/70*** | (2011.01) |
| ***H01R 24/60*** | (2011.01) |
| *H01R 13/506* | (2006.01) |
| *H01R 24/64* | (2011.01) |
| *H01R 43/24* | (2006.01) |
| *H01R 107/00* | (2006.01) |

(52) U.S. Cl.
CPC ..... *H01R 12/725* (2013.01); *H01R 13/405* (2013.01); *H01R 13/6581* (2013.01); *H01R 13/6594* (2013.01); *H01R 24/60* (2013.01); *H01R 13/506* (2013.01); *H01R 24/64* (2013.01); *H01R 43/24* (2013.01); *H01R 2107/00* (2013.01)

(58) Field of Classification Search
CPC ..... H01R 12/725; H01R 24/60; H01R 24/64; H01R 43/24
USPC ..... 439/660, 607.01, 607.2, 607.24, 607.32, 439/607.35, 607.36, 607.07, 607.09, 439/607.11, 607.13, 607.53, 607.54, 439/607.55
See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,306,336 | B2 * | 4/2016 | Chang | H01R 13/6471 |
| 9,337,588 | B2 * | 5/2016 | Chang | H01R 13/6594 |
| 9,450,355 | B2 * | 9/2016 | Zhang | H01R 24/60 |
| 9,461,388 | B2 | 10/2016 | Zhao et al. | |
| 9,525,244 | B1 * | 12/2016 | Hsu | H01R 13/6585 |
| 9,847,614 | B1 * | 12/2017 | Wu | H01R 12/75 |
| 9,960,522 | B2 | 5/2018 | Tada et al. | |
| 9,972,952 | B2 | 5/2018 | Guo | |
| 9,979,152 | B2 | 5/2018 | Zhang et al. | |
| 10,063,024 | B2 | 8/2018 | Yao et al. | |
| 10,224,673 | B2 * | 3/2019 | Sun | H01R 13/6275 |
| 2010/0075542 | A1 * | 3/2010 | Ho | H01R 13/4367 439/660 |
| 2010/0279546 | A1 * | 11/2010 | Yang | H01R 13/65802 439/607.31 |
| 2012/0322282 | A1 | 12/2012 | Naito et al. | |
| 2014/0357124 | A1 | 12/2014 | Zhao et al. | |
| 2015/0044899 | A1 | 2/2015 | Fan et al. | |
| 2016/0240977 | A1 * | 8/2016 | Yu | H01R 13/6471 |
| 2016/0359274 | A1 | 12/2016 | Zhang et al. | |
| 2017/0346216 | A1 | 11/2017 | Tada et al. | |
| 2018/0269620 | A1 | 9/2018 | Hayashi et al. | |

FOREIGN PATENT DOCUMENTS

| | | | |
|---|---|---|---|
| JP | 6005806 | B1 | 10/2016 |
| JP | 2016197591 | A | 11/2016 |
| KR | 1020160101520 | A | 8/2016 |
| WO | 2016163141 | A1 | 10/2016 |
| WO | 2017047214 | A1 | 3/2017 |

OTHER PUBLICATIONS

Korean Office Action (and English language translation thereof) dated Jun. 26, 2019 issued in counterpart Korean Application No. 10-2018-0114113.

Taiwanese Office Action (and English language translation thereof) dated Jun. 28, 2019 issued in counterpart Taiwanese Application No. 107132214.

* cited by examiner

CONNECTOR MOUNTABLE ON AN UPPER SURFACE OF A CIRCUIT BOARD

CROSS REFERENCE TO RELATED APPLICATIONS

This application is based on and claims priority under 35 U.S.C. § 119 to Japanese Patent Application No. JP2017-195039 filed Oct. 5, 2017, the contents of which are incorporated herein in their entireties by reference.

BACKGROUND OF THE INVENTION

This invention relates to a connector, in particular, to a connector of a surface-mount type which is mountable on a circuit board.

Referring to FIG. 18, a connector 90 described in KR 10-2016-0101520A (Patent Document 1) is provided with a plurality of contacts 92, a holding member 94 holding the contacts 92 and a shell 96 accommodating the holding member 94 at least in part. The shell 96 is formed with lugs 960 for fixing the holding member 94 to the shell 96. Also, the shell 96 is formed with an inspection aperture 962 to see whether fixed portions (not shown) of the contacts 92 are securely fixed to fixing portions (not shown) of a circuit board (not shown) when the connector 90 is mounted on a surface of the circuit board.

SUMMARY OF THE INVENTION

In the connector 90 of Patent Document 1, the lugs 960 formed to the shell 96 are small in size. Therefore, there is a problem that the lugs 960 are hard to engage with predetermined parts of the holding member 94 and to fix securely the holding member 94 to the shell 96. Although enlarging the size of the lugs 960 may be conceived to solve the problem, enlarging simply the size of the lugs 960 needs enlarging the size of the shell 96. On the other hand, there is a request not to enlarge the size of the shell 96.

Therefore, it is an object of the present invention to provide a connector with a lug which is used to fix a holding member to a shell and enlarged in size without enlarging a size of the shell.

One aspect of the present invention provides a connector which is mountable on an upper surface of a circuit board in an up-down direction and mateable with a mating connector in a front-rear direction perpendicular to the up-down direction. The connector comprises a plurality of contacts, a holding member and a shell. Each of the contacts has a held portion and a fixed portion to be fixed to the circuit board. The holding member has a holding portion holding the held portions, a front regulated portion and a rear regulated portion. The shell is formed with at least one front regulating portion, at least one opening portion and at least one rear regulating portion extending into the at least one opening portion. The at least one opening portion is closed on a surface of the shell and penetrates the shell in a direction perpendicular to the front-rear direction. The at least one front regulating portion is located forward of the front regulated portion and regulates forward movement of the front regulated portion. The at least one rear regulating portion is located rearward of the rear regulated portion and regulates rearward movement of the rear regulated portion. At least a part of the fixed portions of the contacts is visible through the at least one opening portion.

In the connector of the present invention, the shell is formed with the at least one opening portion and the rear regulating portion extending into the opening portion. The opening portion includes a part formed inevitably due to formation of the rear regulating portion. The opening portion is also formed so that at least a part of the fixed portions of the contacts is visible. In other words, the connector of the present invention is not provided with an opening portion purely for making the fixed portions of the contacts visible. Thus, the connector of the present invention can enlarge a lug (or the rear regulating portion), which fixes the holding member to the shell, without enlarging the size of the shell, and therefore the holding member can be securely fixed to the shell.

An appreciation of the objectives of the present invention and a more complete understanding of its structure may be had by studying the following description of the preferred embodiment and by referring to the accompanying drawings.

Figure 1:
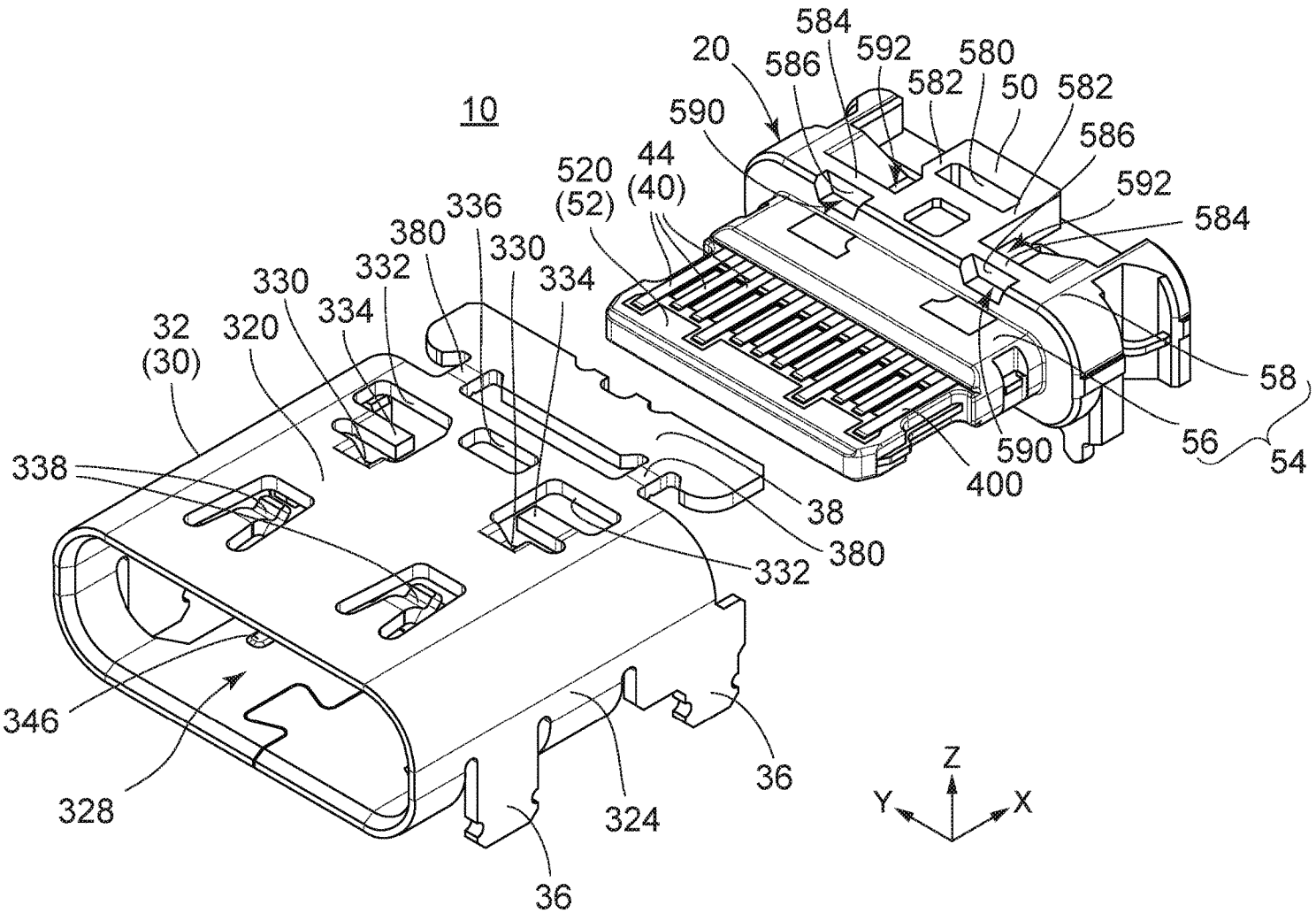
FIG. 1 is a perspective view showing a connector according to an embodiment of the present invention. The connector is in the middle of its assembly, and a connector body and a shell are separated from each other. Upper rear regulating portions and connection portions have not yet been bent.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 8:
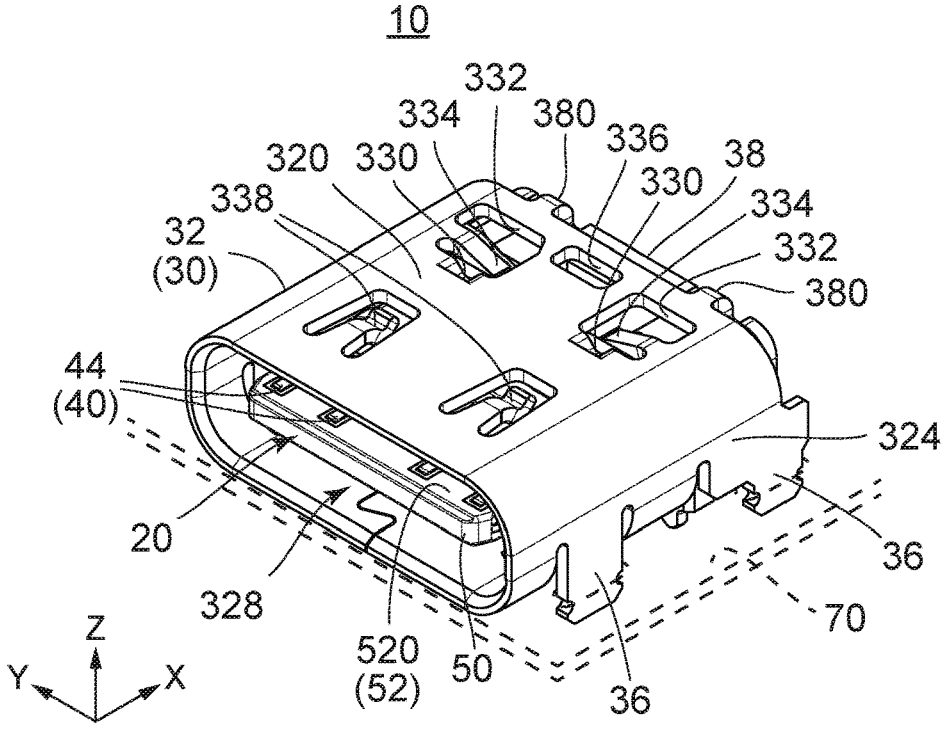
FIG. 8 is a perspective view showing the connector of FIG. 7. The connector is in an assembly complete state, and the upper rear regulating portions and the connection portions are bent.

As shown in FIG. 8, a connector 10 according to an embodiment of the invention is a connector of a surface-mount type that is mountable on a surface of a circuit board 70. In the present embodiment, the connector 10 is mounted on an upper surface of the circuit board 70 in an up-down direction. In addition, the connector 10 is a connector which is mateable with and removable from a mating connector (not shown) in a front-rear direction perpendicular to the up-down direction. In the present embodiment, the up-down direction is a Z-direction. A positive Z-direction is directed upward while a negative Z-direction is directed downward. Moreover, the front-rear direction is an X-direction. A positive X-direction is directed rearward while a negative X-direction directed forward.

Referring to FIG. 1, the connector 10 is provided with a connector body 20 and a shell 30 accommodating the connector body 20 therein. The connector body 20 has a plurality of contacts 40 and a holding member 50 holding the contacts 40.

Figure 6:
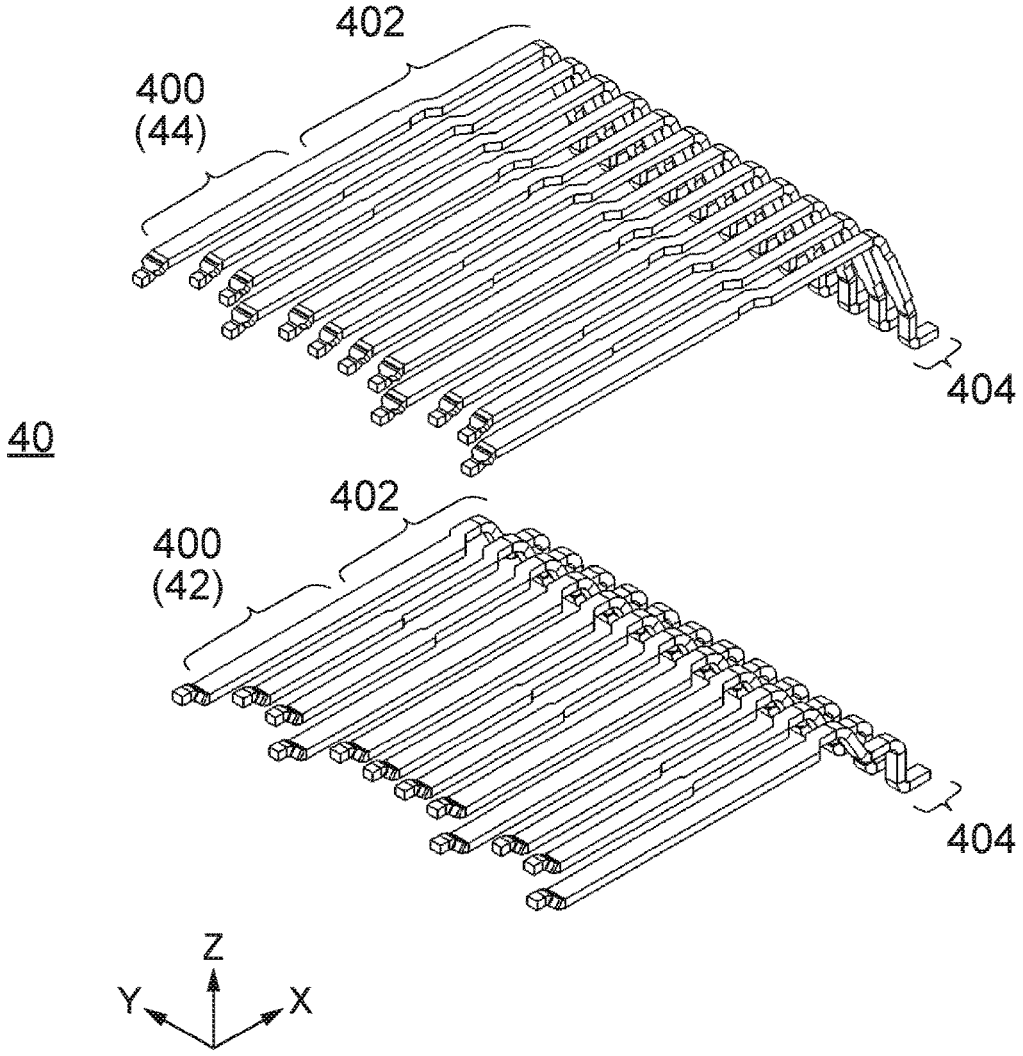
FIG. 6 is a perspective view showing contacts included in the connector of FIG. 1.

As shown in FIG. 6, the contacts 40 include lower-row contacts (contacts) 42 and upper-row contacts (additional contacts) 44. In addition, the contacts 40 include signal contacts and power supply contacts. The contacts 40 have the same basic structure as one another even when they are different from one another in size and shape. In other words, each of the contacts 40 has a contact portion 400, a held portion 402 and a fixed portion 404. The contact portion 400 is a part which is brought into contact with a contact portion (not shown) of a mating contact (not shown). The held portion 402 is a part which is held by the holding member 50. The fixed portion 404 is a part which is connected and fixed to a connecting pad (not shown) of the circuit board 70 (see FIG. 8) when the connector 10 is mounted on the circuit board 70. However, the present invention is not limited thereto. The contact 40 may be provided with, as a substitute for the contact portion 400, a contact point and a supporting portion which is resiliently deformable and supports the contact point. In the present embodiment, the lower-row contacts 42 can be made by punching out a metal sheet and bending metal pieces punched out. Similarly, the upper-row contacts 44 are made by punching out a metal sheet and bending metal pieces punched out.

As understood from FIGS. 1 and 3 to 5, the holding member 50 has a fitting portion 52 and a holding portion 54. The holding portion 54 has a front holding portion 56 and a rear holding portion 58. The fitting portion 52 has an upper surface 520 and a lower surface 522 and further has a tongue-like shape. The fitting portion 52 protrudes forward from the front holding portion 56. The front holding portion 56 is located rearward of the fitting portion 52. In the up-down direction, the front holding portion 56 is larger than the fitting portion 52 in size. The front holding portion 56 functions as a supporting portion to support the fitting portion 52. The rear holding portion 58 is located rearward of the front holding portion 56. The rear holding portion 58 is larger than the front holding portion 56 in size in each of the up-down direction and a lateral direction perpendicular to the up-down direction. The rear holding portion 58 functions as a fixed portion to be fixed to the shell 30. In the present embodiment, the lateral direction is a Y-direction. In the present embodiment, the holding member 50 consists of a first insulating resin portion, a second insulating resin portion and a third insulating resin portion. The first insulating resin portion is integrally molded with the lower-row contacts 42. The second insulating resin portion is integrally molded with the upper-row contacts 44. The third insulating resin portion is integrally molded with the first insulating resin portion and the second insulating resin portion. However, the present invention is not limited thereto. The holding member 50 may be formed of a single insulating resin portion.

As understood from FIGS. 2 to 5, in a state that the contacts 40 are held by the holding member 50, the contact portions 400 of the contacts 40 are arranged in two rows juxtaposed with each other in the up-down direction. In detail, the contact portions 400 of the upper-row contacts 44 are arranged on the upper surface 520 of the fitting portion 52. Each of the contact portions 400 of the upper-row contacts 44 is partly embedded in the fitting portion 52 and exposed outside in part. On the other hand, the contact portions 400 of the lower-row contacts 42 are arranged on the lower surface 522 of the fitting portion 52. Each of the contact portions 400 of the lower-row contacts 42 is partly embedded in the fitting portion 52 and exposed outside in part.

Figure 3:
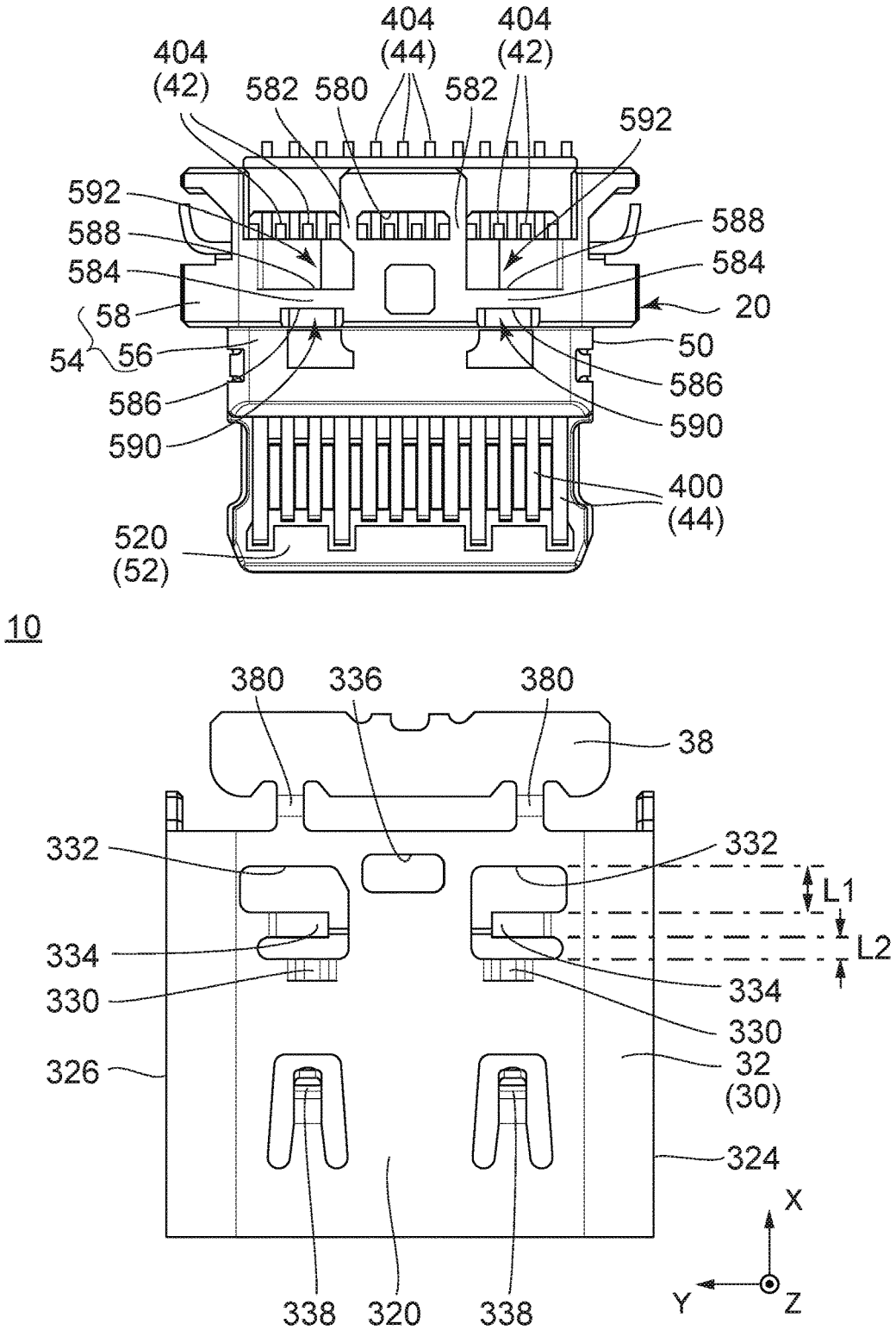
FIG. 3 is a plan view showing the connector of FIG. 1.
Figure 4:
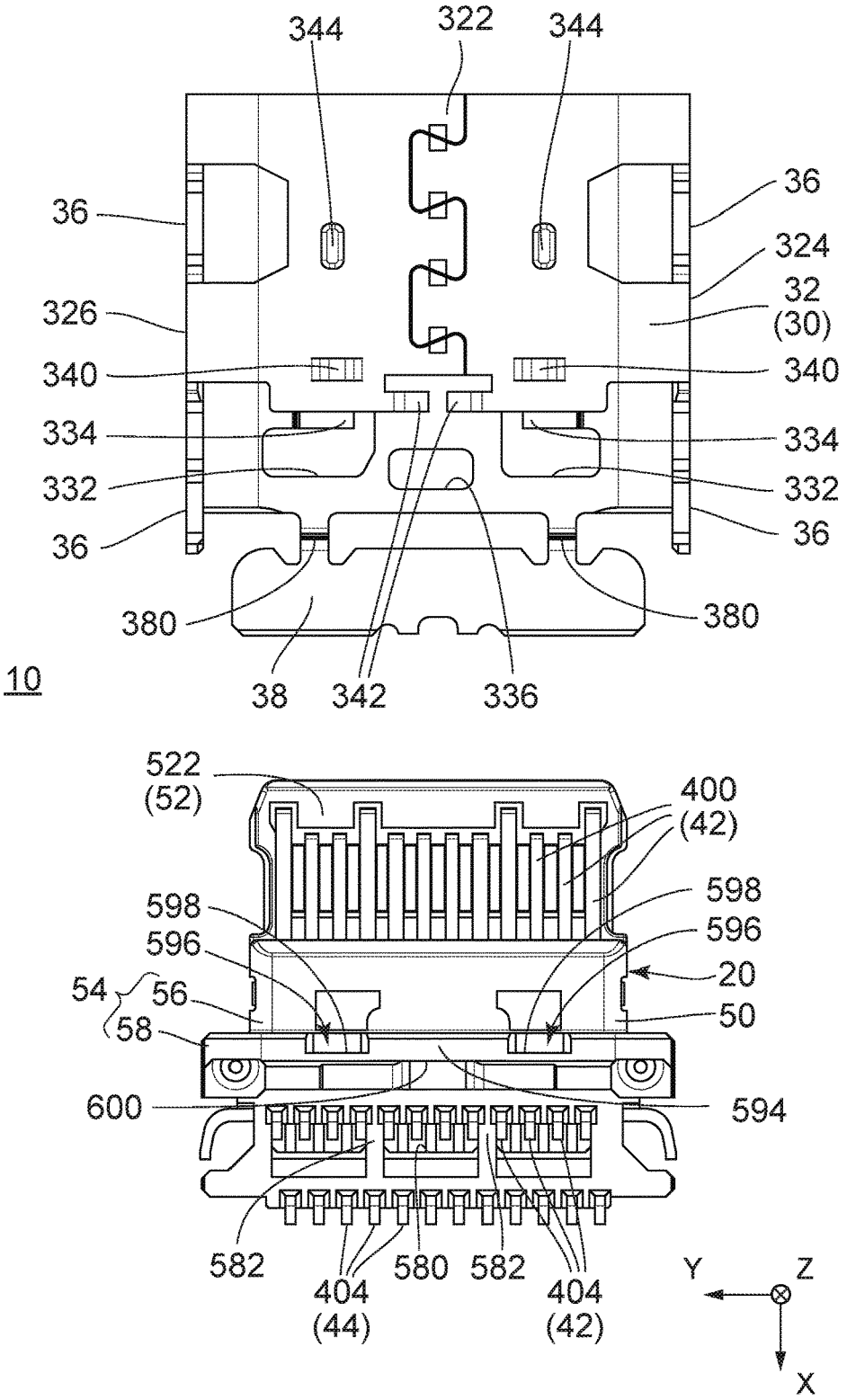
FIG. 4 is a bottom view showing the connector of FIG. 1.
Figure 5:
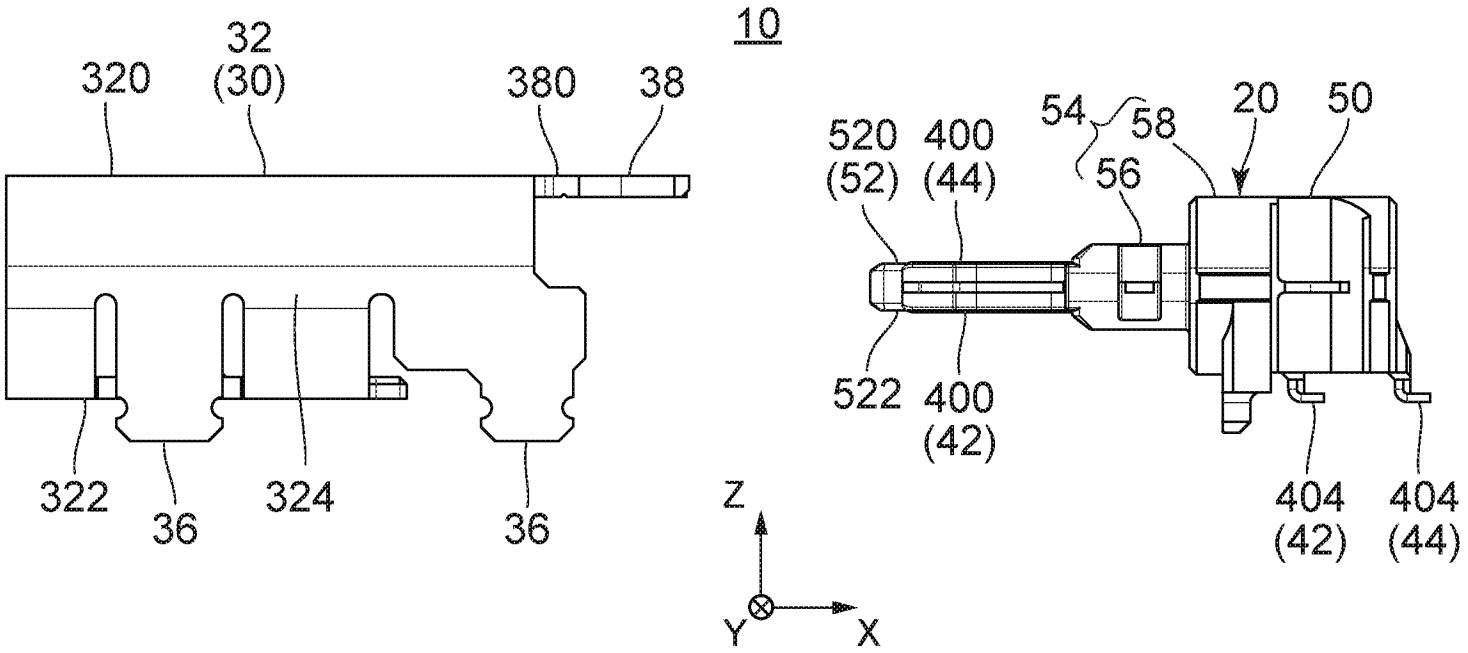
FIG. 5 is a right-side view showing the connector of FIG. 1.

As shown in FIGS. 3 to 5, in the state that the contacts 40 are held by the holding member 50, the fixed portions 404 of the contacts 40 are arranged in two rows juxtaposed with each other in the front-rear direction. In the front-rear direction, the fixed portions 404 of the lower-row contacts 42 are located forward of the fixed portions 404 of the upper-row contacts 44. As shown in FIG. 5, the fixed portions 404 protrude downward from the rear holding portion 58 and further extend rearward.

As understood from FIGS. 3 and 4, the rear holding portion 58 is formed with an opening portion (inner opening portion) 580 penetrating the rear holding portion 58 in the up-down direction. The opening portion 580 has a long shape in the lateral direction. In detail, the opening portion 580 is formed to make all of the fixed portions 404 of the lower-row contacts 42 visible when viewed from above in the up-down direction. In consideration of flowability of resin at the time of molding the holding member 50, the opening portion 580 is formed with beam portions 582 extending in the front-rear direction. In the present embodiment, the beam portions 582 are two in number. The opening portion 580 is divided into three regions by the beam portions 582. However, the present invention is not limited thereto. The opening portion 580 may be formed of a single region or may be divided into two regions or four or more regions.

As shown in FIGS. 1 and 3, the rear holding portion 58 is further provided with upper regulated walls 584 in the upper part thereof. In the present embodiment, the upper regulated walls 584 are two in number. Each of the upper regulated walls 584 has a front surface 586 and a rear surface 588. The front surface 586 defines an upper front hollow 590 in part while the rear surface 588 defines an upper rear hollow 592 in part. In other words, the upper regulated wall 584 is located between the upper front hollow 590 and the upper rear hollow 592 in the front-rear direction. As described later with referring to FIGS. 14 and 15, the front surface 586 of the upper regulated wall 584 functions as a front regulated portion while the rear surface 588 functions as a rear regulated portion. Thus, the holding member 50 has the front regulated portions 586 and the rear regulated portions 588. However, the present invention is not limited thereto. One of a pair of the upper front hollows 590 and a pair of the upper rear hollows 592 may be omitted. Instead, both of them may be omitted. Moreover, the upper regulated walls 584 may be replaced by a single (continuous) upper regulated wall.

As shown in FIG. 4, the rear holding portion 58 is also provided with a lower regulated wall 594 in a lower part thereof. The lower regulated wall 594 is formed with lower hollows 596. In the present embodiment, the lower hollows 596 are two in number. The lower regulated wall 594 has inner wall surfaces 598 which face forward to define the lower hollows 596, respectively, in part. In addition, the lower regulated wall 594 has a rear surface 600 facing rearward. However, the present invention is not limited thereto. The lower regulated wall 594 may not be formed with the lower hollows 596.

As understood from FIGS. 1 to 5, the shell 30 has a tubular portion 32, four leg portions 36 and a rear plate portion 38. In the present embodiment, the shell 30 is formed by processing a metal sheet.

Figure 2:
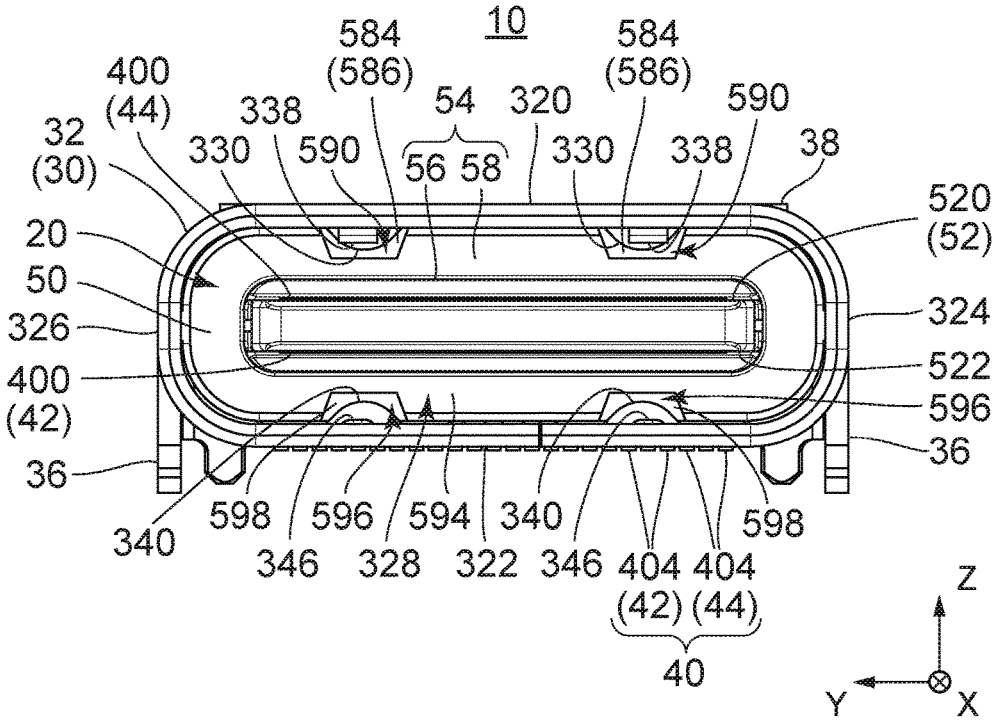
FIG. 2 is a front view showing the connector of FIG. 1.
Figure 9:
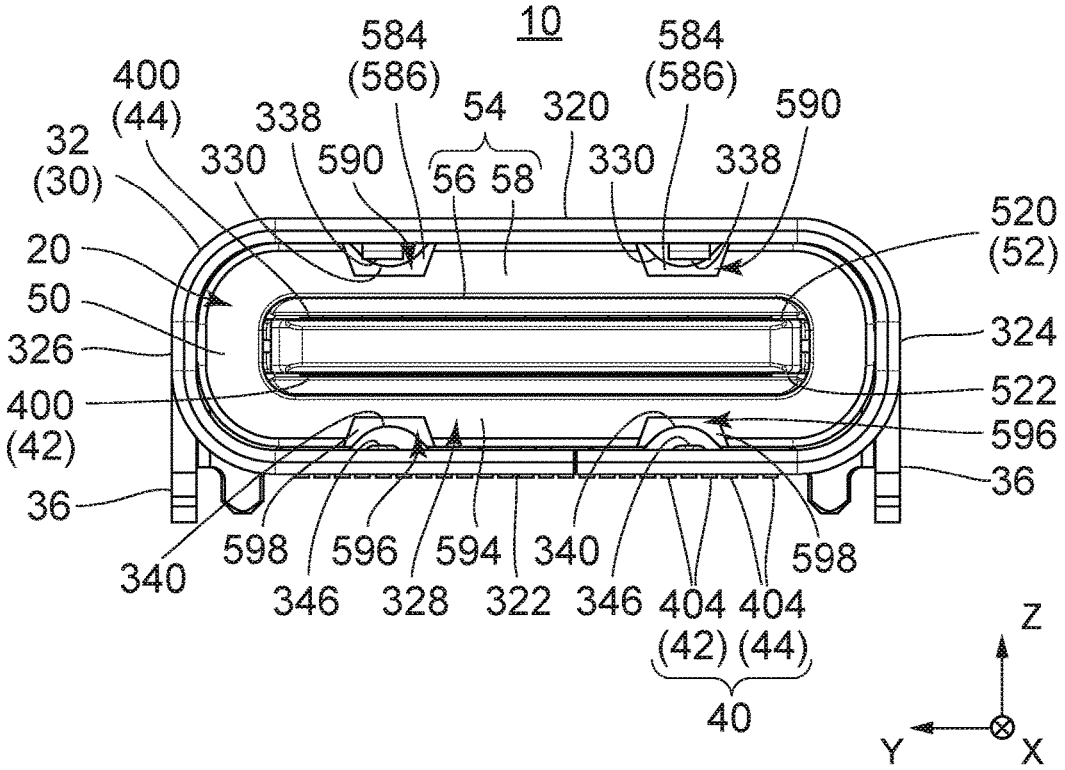
FIG. 9 is a front view showing the connector of FIG. 8.

As understood from FIGS. 1 and 2, the tubular portion 32 has a flat shape in which a size thereof in the up-down direction is smaller than a size thereof in the lateral direction perpendicular to both of the up-down direction and the front-rear direction. As shown in FIGS. 2 to 4, the tubular portion 32 further has an upper surface portion 320, a lower surface portion 322 and side surface portions 324 and 326. The upper surface portion 320 and the lower surface portion 322 are arranged in the up-down direction. The side surface portions 324 and 326 connect the upper surface portion 320 and the lower surface portion 322 to each other. The upper surface portion 320 and the lower surface portion 322 are flat in shape while the side surface portions 324 and 326 are curved in shape. As shown in FIGS. 8 and 9, the tubular portion 32 accommodates the connector body 20 therein and defines a receiving portion 328 together with the connector body 20 accommodated therein to receive a mating fitting portion (not shown) of the mating connector (not shown).

As shown in FIGS. 1 and 2, the leg portions 36 extend downward from the side surface portions 324 and 326 of the tubular portion 32. The leg portions 36 are, as understood from FIG. 8, fixed and electrically connected to the circuit board 70 when the connector 10 is mounted on the circuit board 70.

Figure 7:
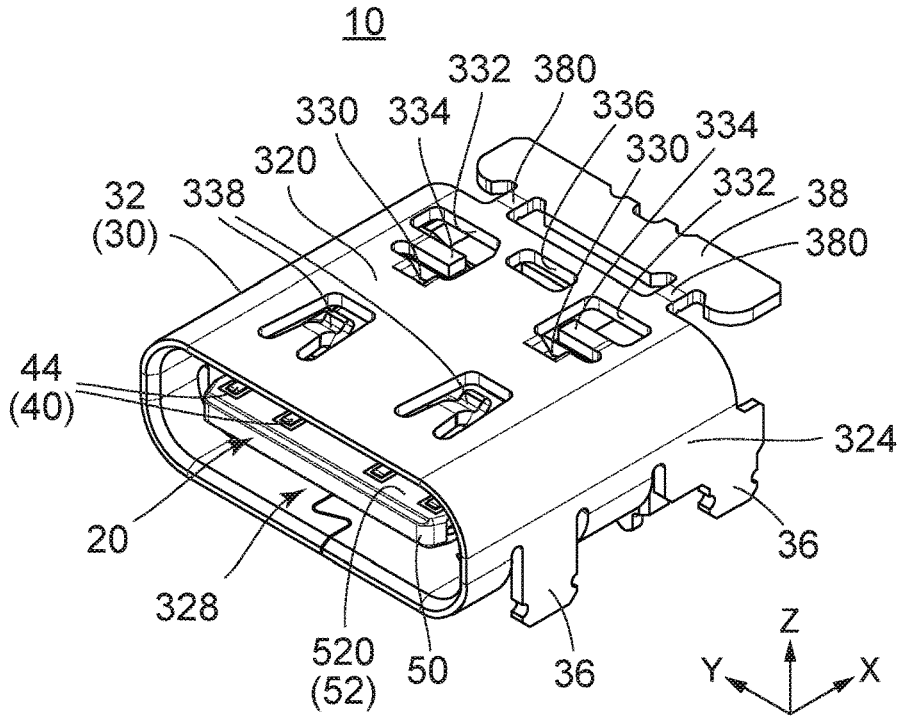
FIG. 7 is a perspective view showing the connector of FIG. 1. The connector is in the middle of its assembly, and the connector body is accommodated in the shell. The upper rear regulating portions and the connection portions have not yet been bent.

As shown in FIGS. 1 and 3 to 5, the rear plate portion 38 is connected to an upper rear edge of the tubular portion 32 via connection portions 380. As understood from FIGS. 7 and 8, the connection portions 380 are bent after the connector body 20 is accommodated in the shell 30, and thereby the rear plate portion 38 covers the connector body 20 from behind in the front-rear direction.

As shown in FIGS. 1 and 3, the upper surface portion 320 of the shell 30 is formed with at least one upper front regulating portion (front regulating portion) 330, at least one opening portion 332 and at least one upper rear regulating portion (rear regulating portion) 334. In the present embodiment, the upper front regulating portions 330, the opening portions 332, and the upper rear regulating portions 334 are two, respectively, in number. Here, the upper surface portion 320 occupies a relatively large part of the shell 30. Accordingly, forming the upper rear regulating portions 334 in the upper surface portion 320 allows the size of the upper rear regulating portions 334 to be large.

As understood from FIGS. 1 and 3, in the present embodiment, the upper front regulating portions 330 correspond to the upper rear regulating portions 334, respectively. In detail, each of the upper front regulating portions 330 and the upper rear regulating portion 334 corresponding thereto are on an imaginary line extending along the front-rear direction. However, the present invention is not limited thereto. Each of the upper front regulating portions 330 and the upper rear regulating portion 334 corresponding thereto may not be on the imaginary line extending along the front-rear direction. Moreover, the upper rear regulating portions 334 correspond to the opening portions 332, respectively. Each of the upper rear regulating portions 334 is provided to the opening portion 332 corresponding thereto and extends into the opening portion 332 corresponding thereto.

As shown in FIGS. 1 and 3, the upper surface portion 320 of the shell 30 is further formed with an additional opening portion 336 and a pair of press portions 338.

As understood from FIGS. 1 and 3, the opening portions 332 are formed by punching out parts from the upper surface portion 320 so that the upper rear regulating portions 334 are formed. In other words, the upper rear regulating portions 334 are formed by forming the opening portions 332. The opening portions 332 are closed in a surface of the shell 30 and penetrate the upper surface portion 320 of the shell 30 in the up-down direction. However, the present invention is not limited thereto. The opening portions 332 may be formed to reach the side surface portions 324 and 326, respectively, in part. In such a case, each of the opening portions 332 penetrates the shell 30 in a direction perpendicular to the front-rear direction. At any rate, each of the opening portions 332 is closed in the surface of the shell 30. Accordingly, the shell 30 can prevent strength reduction thereof and maintain high strength thereof in comparison with a case where cut portions are formed at an edge of the shell 30. Furthermore, in the present embodiment, the opening portion 332 has an approximately U-shape when viewed from above in the up-down direction. In the present embodiment, the opening portion 332 has a first length L1 rearward of the upper rear regulating portion 334 and a second length L2 forward of the upper rear regulating portion 334 in the front-rear direction. The first length L1 is longer than the second length L2.

As understood from FIGS. 1 and 3, the additional opening portion 336 penetrates the upper surface portion 320 of the shell 30 in the up-down direction. The additional opening portion 336 is located between two of the opening portions 332 in the lateral direction. The additional opening portion 336 is located to overlap the opening portions 332 in the front-rear direction.

As understood from FIGS. 1 and 3, each of the upper rear regulating portions 334 is formed as a cantilever to extend inward in the lateral direction. As understood from FIGS. 7 and 8, the upper rear regulating portions 334 are bent after the connector body 20 is accommodated in the shell 30. In detail, each of the upper rear regulating portions 334 is bent into the tubular portion 32 so as to extend in a direction perpendicular to the front-rear direction and intersecting obliquely with the up-down direction.

As shown in FIG. 3, each of the upper front regulating portions 330 is provided to a front edge of the opening portion 332 to which the upper rear regulating portion 334 corresponding thereto is formed. As understood from FIGS. 1 and 2, the upper front regulating portions 330 are formed by making parts of the upper surface portion 320 of the shell 30 protrude downward. In order to form the upper front regulating portions 330, the upper surface portion 320 is formed with slits extending in the lateral direction in positions away from the front edges of the opening portions 332 by a predetermined distance in the front-rear direction. The parts of the upper surface portion 320 that are located rearward of the slits are pressed and deformed downward to form the upper front regulating portions 330.

Figure 14:
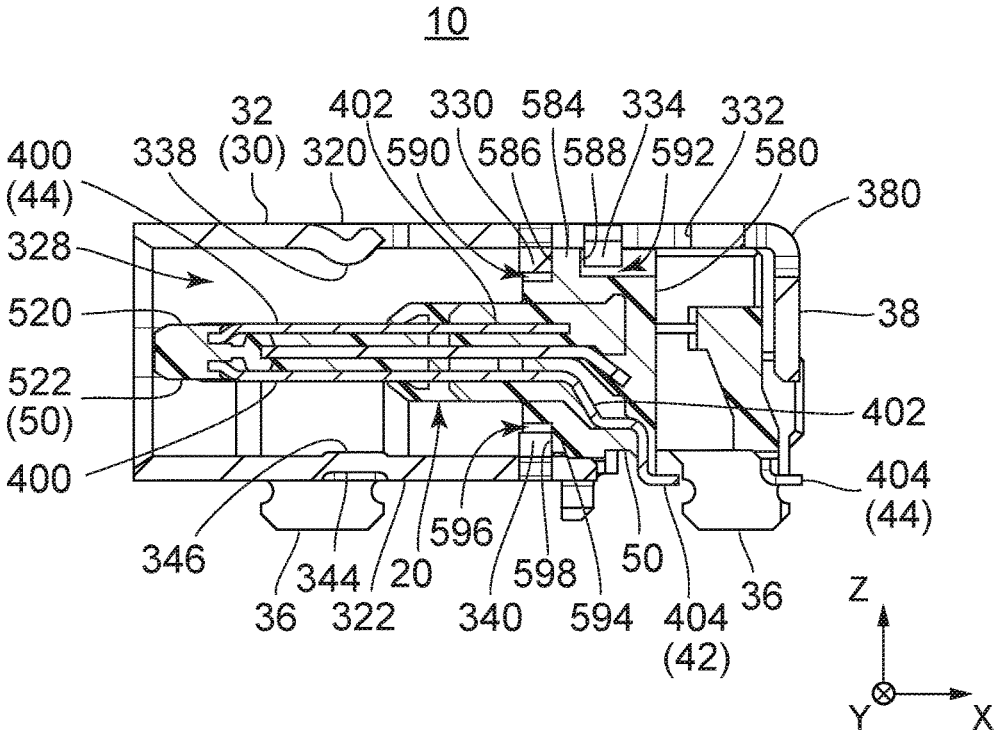
FIG. 14 is a cross-sectional view showing the connector of FIG. 10, taken along line B-B.

As understood from FIGS. 1 and 3, each of the press portions 338 is formed as a cantilever to extend rearward. As shown in FIG. 14, the press portion 338 is curved to protrude downward in part.

As shown in FIG. 4, the lower surface portion 322 of the shell 30 is formed with a pair of lower front regulating portions 340, a pair of lower rear regulating portions 342 and a pair of recess portions 344.

As understood from FIGS. 2 and 4, the lower front regulating portions 340 are formed by making parts of the lower surface portion 322 of the shell 30 protrude upward. In order to form the lower front regulating portions 340, two pairs of slits are formed in the lower surface portion 322. In each of the pairs, the slits are separated from each other by a predetermined distance in the front-rear direction, and they extend in the lateral direction. A part of the lower surface portion 322 located between the slits of each of the pairs is pressed and deformed upward to form the lower front regulating portion 340. As understood from FIGS. 2, 9, 14 and 15, in the present embodiment, the lower front regulating portions 340 are formed in positions where they overlap with the upper front regulating portions 330, respectively, when viewed along the up-down direction.

As shown in FIG. 4, the lower rear regulating portions 342 are formed along a rear edge of the lower surface portion 322. The lower rear regulating portions 342 are located inward of the lower front regulating portions 340 in the lateral direction. Each of the lower rear regulating portions 342 is formed as a cantilever to extend inward in the lateral direction. The lower rear regulating portions 342 are bent after the connector body 20 is accommodated in the shell 30. In detail, each of the lower rear regulating portions 342 is bent into the tubular portion 32 so as to extend in a direction perpendicular to the front-rear direction and intersecting obliquely with the up-down direction.

As understood from FIG. 14, the recess portions 344 are formed as a result of formation of protruding portions 346 protruding inside the tubular portion 32 from the lower surface portion 322. As understood from FIGS. 2, 9 and 14, the protruding portions 346 face the press portions 338 in the up-down direction. When the connector 10 is mated with the mating connector (not shown), the mating fitting portion (not shown) of the mating connector is sandwiched by the press portions 338 and the protruding portions 346. In detail, the press portions 338 press the mating fitting portion (not shown) of the mating connector against the protruding portions 346 by their reaction forces. As a result, the press portions 338 and the protruding portions 346 hold the mating fitting portion of the mating connector.

As understood from FIGS. 1, 3 to 5 and 7, the connector body 20 is inserted into the tubular portion 32 from behind the shell 30. In a state that the connector body 20 is accommodated in the tubular portion 32 of the shell 30, the upper rear regulating portions 334 are, as shown in FIG. 8, bent into the shell 30 in a plane perpendicular to the front-rear direction. Similarly, the lower rear regulating portions 342 are bent into the shell 30 in the plane perpendicular to the front-rear direction. As a result, each of the upper rear regulating portions 334 extends in the direction perpendicular to the front-rear direction and intersecting obliquely with the up-down direction. Each of the lower rear regulating portions 342 extends in the direction perpendicular to the front-rear direction and intersecting obliquely with the up-down direction. Furthermore, as shown in FIGS. 7, 8 and 10 to 12, the connection portions 380 are bent so that the rear plate portion 38 is perpendicular to the front-rear direction. In this way, assembly of the connector 10 is completed.

Figure 10:
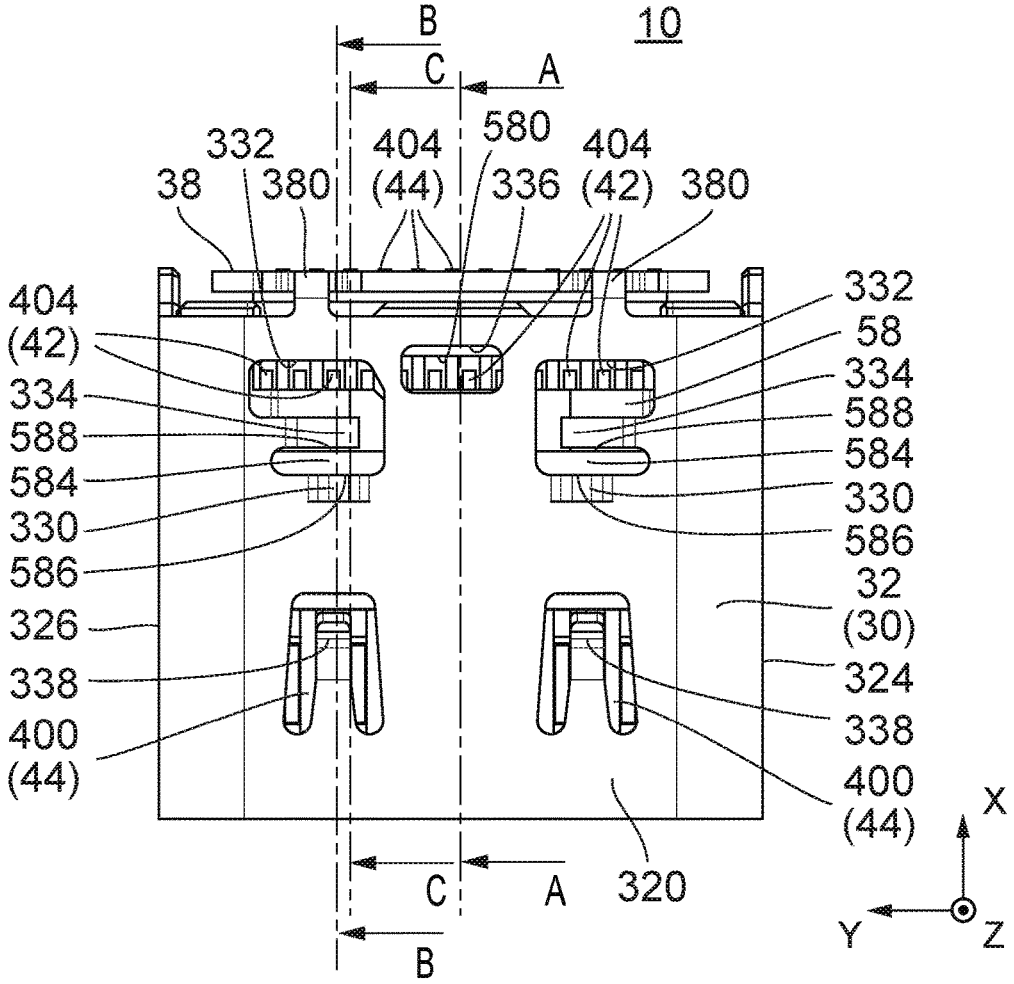
FIG. 10 is a plan view showing the connector of FIG. 8.
Figure 11:
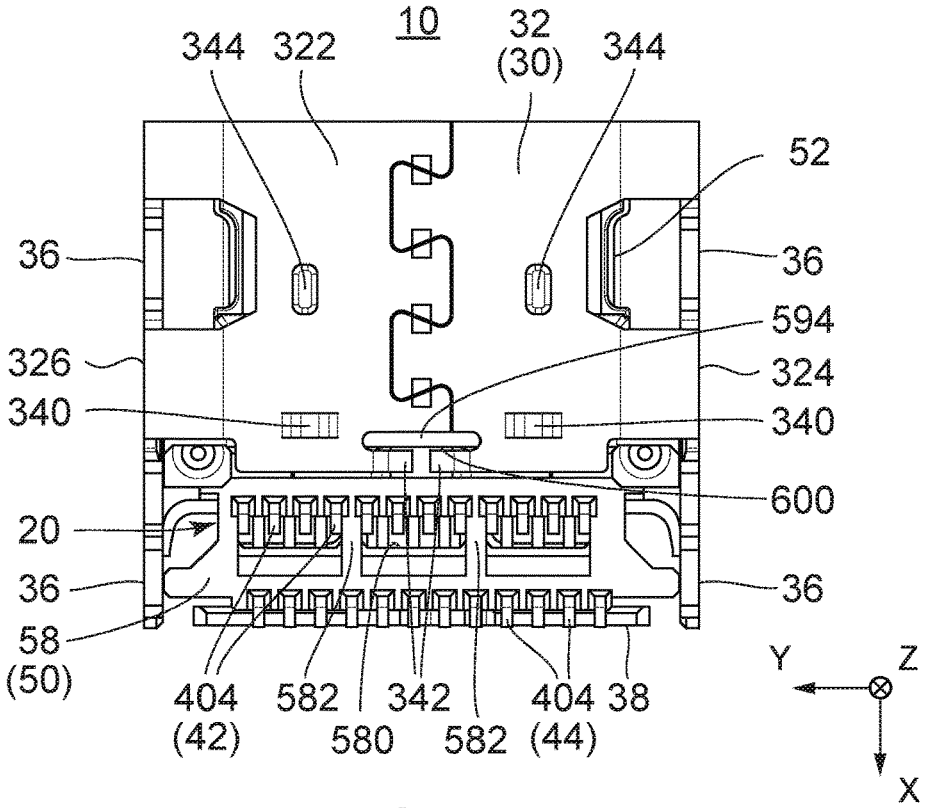
FIG. 11 is a bottom view showing the connector of FIG. 8.
Figure 12:
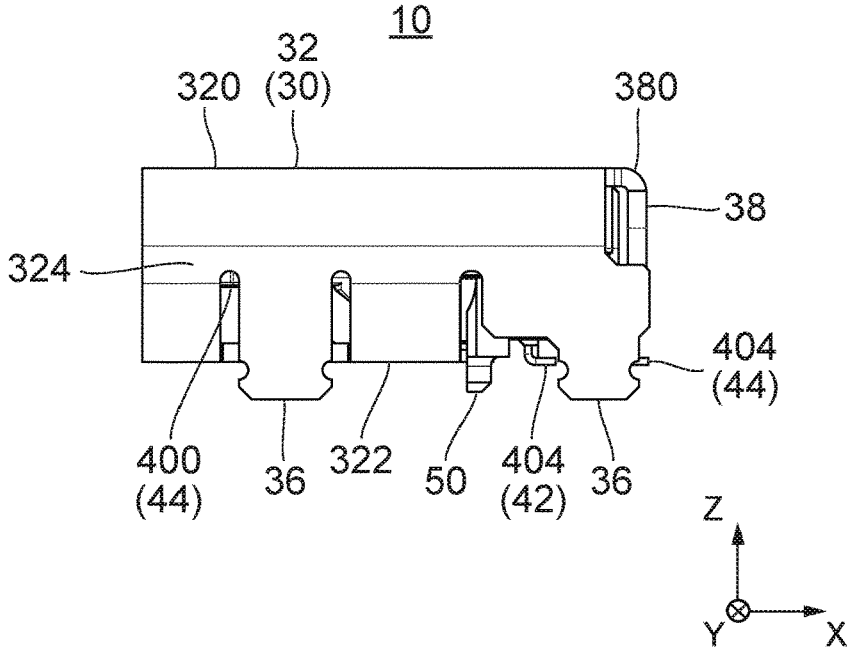
FIG. 12 is a right-side view showing the connector of FIG. 8.

As shown in FIG. 10, in the connector 10 completely assembled, the upper regulated walls 584 are sandwiched between the upper front regulating portions 330 and the upper rear regulating portions 334 in the front-rear direction. In other words, the front regulated portions 586 and the rear regulated portions 588 are sandwiched between the front regulating portions 330 and the rear regulating portions 334 in the front-rear direction. Then, as understood from FIGS. 14 and 15, the upper front regulating portions 330 are accommodated in the upper front hollows 590, respectively, at least in part while the upper rear regulating portions 334 are accommodated in the upper rear hollows 592, respectively, at least in part. In this state, the upper front regulating portions 330 are located forward of the front surfaces 586 of the upper regulated walls 584 and regulate forward movement of the front surfaces 586 of the upper regulated walls 584. In addition, the upper rear regulating portions 334 are located rearward of the rear surfaces 588 of the upper regulated walls 584 and regulate rearward movement of the rear surfaces 588 of the upper regulated walls 584. Thus, the holding member 50 is securely fixed to the shell 30 by the upper front regulating portions 330 and the upper rear regulating portions 334.

Figure 13:
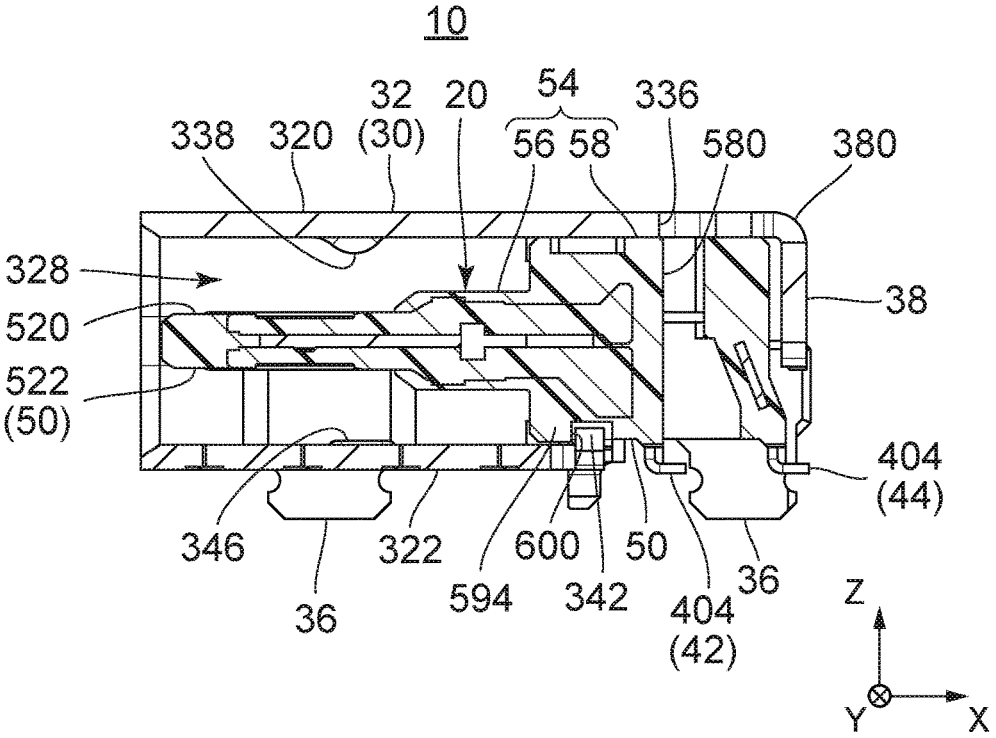
FIG. 13 is a cross-sectional view showing the connector of FIG. 10, taken along line A-A.
Figure 15:
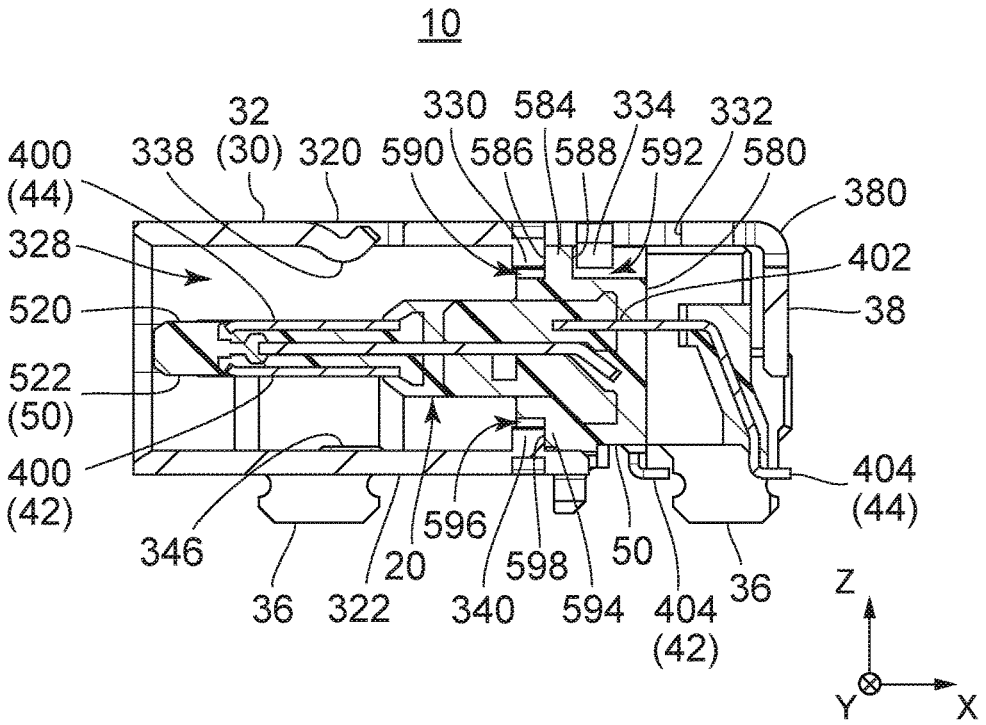
FIG. 15 is a cross-sectional view showing the connector of FIG. 10, taken along line C-C.

As understood from FIGS. 14 and 15, in the connector 10 completely assembled, the lower front regulating portions 340 are accommodated in the lower hollows 596 of the lower regulated wall 594, respectively, at least in part. The lower front regulating portions 340 are located forward of the inner wall surfaces 598 of the lower hollows 596 in the front-rear direction and regulate forward movement of the lower regulated walls 594. As understood from FIGS. 11 and 13, the lower rear regulating portions 342 are located rearward of the rear surface 600 of the lower regulated wall 594 in the front-rear direction. The lower rear regulating portions 342 are located behind the rear surface 600 of the lower regulated wall 594 and regulate rearward movement of the rear surface 600 of the lower regulated wall 594. Thus, the holding member 50 is securely fixed to the shell 30 by the lower front regulating portions 340 and the lower rear regulating portions 342.

As shown in FIG. 10, when the connector 10 completely assembled is viewed from above in the up-down direction, the opening portions 332 of the shell 30 overlap with the opening portion 580 of the holding member 50. Accordingly, when viewed from above in the up-down direction, at least a part of the fixed portions 404 of the lower-row contacts 42 is visible through each of the opening portions 332. In the present embodiment, through each of the opening portions 332, four of the fixed portions 404 of the lower-row contacts 42 are visible in part. In each of the fixed portions 404 viewed, two edges thereof are visible, wherein the two edges include a rear edge at least in part. Moreover, in the present embodiment, the additional opening portion 336 of the shell 30 also overlaps with the opening portion 580 of the holding member 50 when viewed from above in the up-down direction. Accordingly, when viewed from above in the up-down direction, a part of the fixed portions 404 of the lower-row contacts 42 is visible through the additional opening portion 336. In the present embodiment, through the additional opening portion 336, four of the fixed portions 404 of the lower-row contacts 42 are visible in part. In each of the fixed portion 404 viewed, at least two edges thereof are visible, wherein the at least two edges include a rear edge at least in part. As a result, in the present embodiment, when viewed from above in the up-down direction, all of the fixed portions 404 of the lower-row contacts 42 are visible through the opening portions 332 and the additional opening portion 336. In other words, each of the fixed portions 404 of the lower-row contacts 42 is visible through any one of the opening portions 332 and the additional opening portion 336. Accordingly, in a state that the connector 10 is mounted on the circuit board 70, it can be seen whether the fixed portions 404 of the lower-row contacts 42 are appropriately fixed and connected to the connecting pads formed on the circuit board 70. Although all of the fixed portion 404 of the lower-row contacts 42 are visible in the present embodiment when viewed from above in the up-down direction, the present invention is not limited thereto. It is sufficient that every one of the fixed portions 404 of the lower-row contacts 42 can be viewed through the opening portions 332 and the additional opening portion 336 when viewed from a plurality of upper and obliquely upper viewing points. Additionally, in the present embodiment, the fixed portions 404 of the upper-row contacts 44 are visible from obliquely above in the state that the connector 10 is mounted on the circuit board 70.

As mentioned above, in the connector 10 according to the present embodiment, the upper rear regulating portions 334 are formed in the upper surface portion 320 of the shell 30, and therefore they can be upsized. In addition, because the opening portions 332 include parts formed inevitably by formation of the upper rear regulating portions 334, upsizing the shell 30 caused by upsizing the upper rear regulating portions 334 is avoided. Thus, the connector 10 of the present embodiment can upsize lugs (or the rear regulating portions 334) used to fix the holding member 50 to the shell 30 without upsizing the shell 30, and thereby the holding member 50 can be securely fixed to the shell 30.

Figure 16:
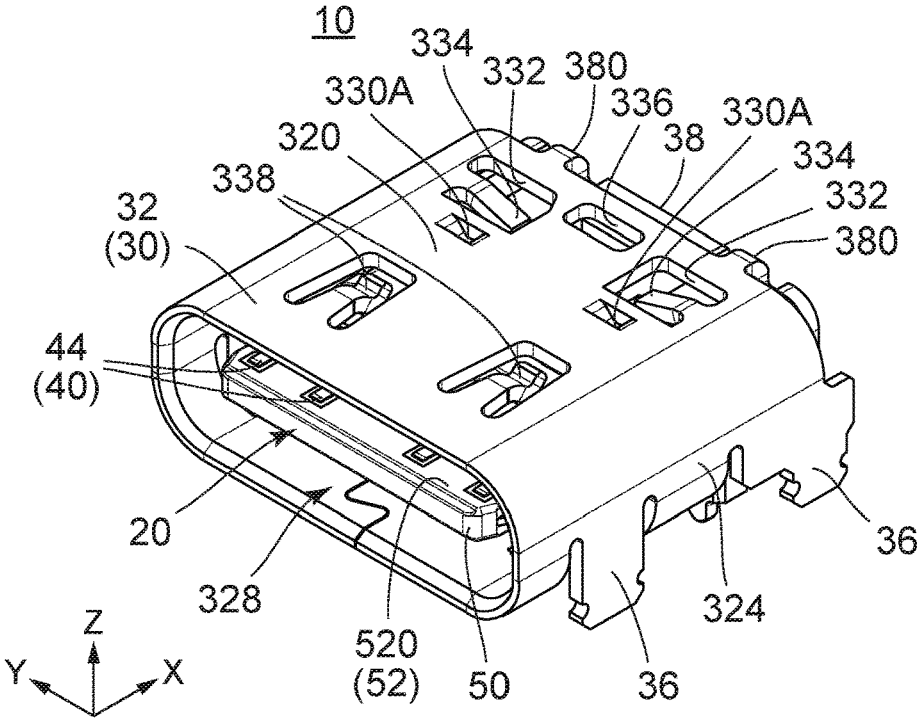
FIG. 16 is a perspective view showing a modified example of the connector according to the embodiment of the invention.
Figure 17:
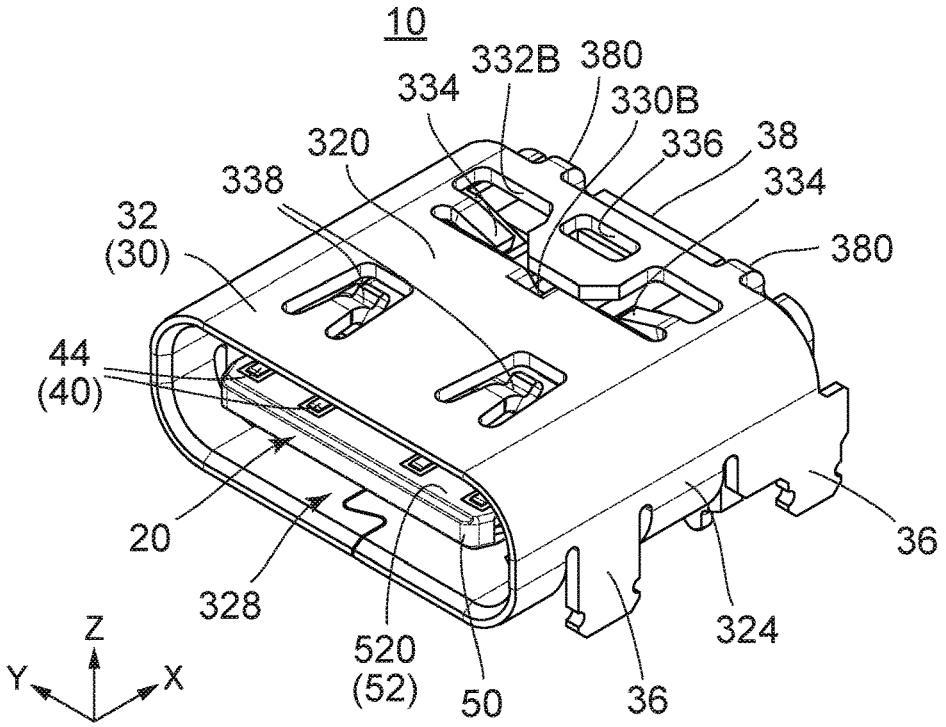
FIG. 17 is a perspective view showing another modified example of the connector according to the embodiment of the invention.
Figure 18:
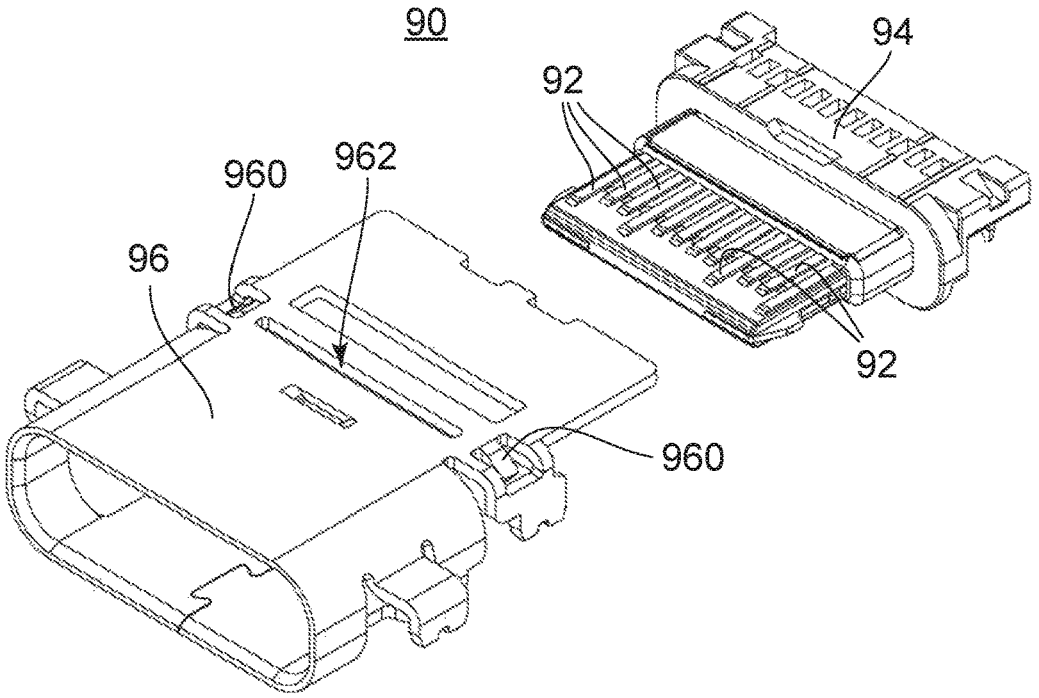
FIG. 18 PRIOR ART
FIG. 18 is a perspective view showing a connector described in Patent Document 1. The connector is in the middle of its assembly.

Although the specific explanation about the present invention is made above referring to the embodiments, the present invention is not limited thereto but susceptible of various modifications and alternative forms without departing from the spirit of the invention. For example, although the upper front regulating portions 330 are formed to the front edges of the opening portions 332 in the aforementioned embodiment, upper front regulating portions 330A may be provided at positions apart from the opening portions 332 as shown in FIG. 16. The upper front regulating portions 330A can be formed by the same manner as that for formation of the lower front regulating portions 340. Although the upper front regulating portions 330 are formed to correspond to the upper rear regulating portions 334 in the aforementioned embodiment, only one upper front regulating portion 330B may be provided as shown in FIG. 17. In this case, a single opening portion 332B may be formed in place of the opening portions 332, and the upper front regulating portion 330B may be formed at a middle part of a front edge of the opening portion 332B.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on an upper surface of a circuit board in an up-down direction and mateable with a mating connector in a front-rear direction perpendicular to the up-down direction, wherein:

the connector comprises a plurality of contacts, a holding member and a shell;

each of the contacts has a held portion and a fixed portion to be fixed to the circuit board;

the holding member has a holding portion holding the held portions, a front regulated portion and a rear regulated portion;

the shell is formed with at least one front regulating portion, at least one opening portion and at least one rear regulating portion extending into the at least one opening portion;

the at least one opening portion is closed on a surface of the shell and penetrates the shell in a direction perpendicular to the front-rear direction;

the at least one front regulating portion is located forward of the front regulated portion and regulates forward movement of the front regulated portion;

the at least one rear regulating portion is located rearward of the rear regulated portion and regulates rearward movement of the rear regulated portion; and at least a part of the fixed portions of the contacts is visible through the at least one opening portion.

2. The connector as recited in claim 1, wherein:

the at least one opening portion comprises two opening portions;

the at least one rear regulating portion comprises two rear regulating portions;

the rear regulating portions are provided to the opening portions, respectively;

the at least one front regulating portion comprises two front regulating portions;

the front regulating portions correspond to the rear regulating portions, respectively; and at least a part of the fixed portions of the contacts is visible through either one of the opening portions.

3. The connector as recited in claim 2, wherein:

the shell is further formed with an additional opening portion; and each of the fixed portions of the contacts is visible through any one of the opening portions and the additional opening portion.

4. The connector as recited in claim 2, wherein each of the rear regulating portions extends in a direction which is perpendicular to the front-rear direction and which intersects obliquely with the up-down direction.

5. The connector as claimed in claim 2, wherein:

the holding member is formed with an inner opening portion penetrating the holding member in the up-down direction; and the inner opening portion overlaps with the opening portions when the connector is viewed from above in the up-down direction.

6. The connector as recited in claim 5, wherein the inner opening portion is formed with a beam portion.

7. The connector as recited in claim 2, wherein:

the connector further comprises additional contacts; and the contacts comprise lower-row contacts while the additional contacts comprise upper-row contacts.

8. The connector as claimed in claim 2, wherein each of the front regulating portions and the rear regulating portion corresponding thereto are aligned on an imaginary line extending in the front-rear direction.

9. The connector as claimed in claim 8, wherein:

each of the front regulating portions is provided on a front edge of the opening portion to which the rear regulating portion corresponding to the front regulating portion is provided; and the front regulated portion and the rear regulated portion are sandwiched between the front regulating portion and the rear regulating portion corresponding to the front regulating portion in the front-rear direction.

10. The connector as claimed in claim 1, wherein when the connector is viewed along the up-down direction, at least a part of the fixed portions of the contacts is visible through the at least one opening portion.

* * * * *